US007124685B2

(12) United States Patent
Re et al.

(10) Patent No.: US 7,124,685 B2
(45) Date of Patent: Oct. 24, 2006

(54) INTERNALLY PIPED PRINT CYLINDER AND METHOD FOR MAKING SAME

(75) Inventors: Dean J. Re, Oneida, WI (US); Jeremy J. Stub, Green Bay, WI (US); Timothy P. Byrnes, Oneida, WI (US)

(73) Assignee: MECA & Technology Machine, Inc., Green Bay, WI (US)

( * ) Notice: Subject to any disclaimer, the term of this patent is extended or adjusted under 35 U.S.C. 154(b) by 36 days.

(21) Appl. No.: 10/847,924

(22) Filed: May 18, 2004

(65) Prior Publication Data

US 2005/0257707 A1 Nov. 24, 2005

(51) Int. Cl.
*B41F 13/10* (2006.01)

(52) U.S. Cl. ..... 101/375; 101/376

(58) Field of Classification Search ..... 101/375, 101/376

See application file for complete search history.

(56) References Cited

U.S. PATENT DOCUMENTS 4,144,812 A * 3/1979 Julian ..... 101/382.1
5,706,731 A * 1/1998 Francille et al. ..... 101/375
5,711,222 A * 1/1998 Taylor et al. ..... 101/383
5,735,206 A * 4/1998 Rossini ..... 101/216
5,904,095 A * 5/1999 Nelson ..... 101/375
6,394,943 B1 * 5/2002 Cormier et al. ..... 492/47
6,401,615 B1 * 6/2002 Heinicke ..... 101/389.1
6,725,774 B1 * 4/2004 Gottling et al. ..... 101/375
6,874,415 B1 * 4/2005 Hoffmann et al. ..... 101/217

* cited by examiner

*Primary Examiner*—Ren Yan
*Assistant Examiner*—Marissa Ferguson-Samreth
(74) *Attorney, Agent, or Firm*—Joseph S. Heino; Patrick M. Bergin

(57) ABSTRACT

A print cylinder having a first header, a second header and a hollow cylinder body is internally piped. The first header includes an air inlet and an air outlet. The air outlet is sealingly connected to a central conduit which is sealingly attached to a disk, the disk being sealed about its perimeter to the cylinder body. The second header includes an air inlet and at least one air outlet, the air outlet being connected to a perimeter groove defined about the outer surface of the second header. Apertures are defined within the print cylinder immediately above the perimeter groove whereby an air flow continuum is created from the air inlet of the first header, through the central conduit, through the second header inlet and outlet, through the perimeter groove and through the cylinder apertures. Secondary apertures are defined within the cylinder body, each connected in an air flow continuum to the central conduit by means of secondary conduits.

10 Claims, 3 Drawing Sheets

INTERNALLY PIPED PRINT CYLINDER AND METHOD FOR MAKING SAME

FIELD OF THE INVENTION

This invention relates generally to the field of printing and to rollers and cylinders used in printing presses. More specifically, it relates to an internally piped print cylinder that facilitates both the placement of a print sleeve onto the cylinder and the removal of the sleeve from the cylinder. It also relates to a method for making the internally piped print cylinder that accomplishes this result.

BACKGROUND OF THE INVENTION

The use of flexible printing plates is well known in the art of printing. The printing plate is typically mounted onto a cylindrically hollow and slightly more rigid print sleeve which, in turn, overlays a cylindrical print cylinder. The print cylinder, usually made of a metal material, then rotates about its longitudinal axis at relatively high speeds. Printing plates mounted to a print cylinder in this fashion are particularly useful for printing images and text on surfaces and materials that are soft, flexible and easily deformable. Such flexible surfaces and materials include packaging materials of paper, plastic films or metal foils, or materials with an irregular surface.

The use of the interposed sleeve provides a surface to which the printing plate can adhere, the print sleeve being relatively rigid in comparison to the generally flexible and pliable printing plate that is secured to it. Moreover, the interposed sleeve allows for the removal of the sleeve, and thus the printing plate, from the print cylinder in order that different print jobs can be run using the same cylinder, the cylinder being a very expansive piece of equipment. In the art, the print sleeve has an inner diameter that is slightly less than that of the outer diameter of the print cylinder. Once in place over the print cylinder, it is intended that the print sleeve frictionally adhere to the print cylinder and not be moved relative to it as the print cylinder rapidly rotates during the printing process. Due to this tight fit, methods and devices have been used to facilitate the mounting of the sleeve onto the cylinder and then the removal of the sleeve from the cylinder.

In the experience of these inventors, at least one such attempt has been made to air pressurize the inside of the print cylinder and then provide a number of small air apertures about the outer perimeter of the cylinder surface. In this fashion, pressurization of the cylinder interior works to provide air flow through the apertures and, in turn, provide the print sleeve with a layer of pressurized air to ride over. This air pressure expands the inner diameter of the sleeve ever so slightly, but enough to allow the sleeve to be placed over the cylinder in a relatively easy fashion. One disadvantage to this type of cylinder pressurization, however, is that it requires a greater volume of pressurized air to accomplish the intended purpose. That is, sufficient air flow through the apertures is only accomplished when the complete interior of the cylinder in adequately pressurized. Not only may such cylinders not qualify as certifiably safe pressure vessels, but there is additional time that is required to pressurize the entire cylinder. This takes time away from production. Additionally, the pressurized air supply typically includes air contaminants, including moisture, which, in larger volume vessels, may accumulate in the vessel and work to corrode and destroy the vessel from within.

SUMMARY OF THE INVENTION

It is therefore an object of the present invention to provide a new and useful print cylinder that is internally piped so as to facilitate the application of a print sleeve to the cylinder and to facilitate the removal of the print sleeve from the cylinder. It is another object of the present invention to provide a method for making the internally piped print cylinder such that a much smaller volume of space is required to be pressurized in order to accomplish the intended result. It is a further object to provide such an internally piped print cylinder that is fabricated in accordance with the method of the present invention as original equipment or as a retrofit to an existing cylinder with the same effect. It is still another object of the device and method of the present invention to fabricate and assemble such a device which will accomplish all of the foregoing without great expense, which will allow printers to readily and easily use the device, and which utilizes a minimum number of elements to assemble and a minimum number of steps to operate.

The apparatus and method of the present invention has obtained these objects. It provides for a method of fabricating or retrofitting a print cylinder that is internally piped. The print cylinder of the present invention includes a drive side header and a tending side header. Extending between the headers is the hollow cylinder body. The drive side header includes an air inlet and an air outlet. The air outlet is sealingly connected to one end of a central cylinder conduit. The other end of the central conduit is sealingly attached to a disk, the disk being sealed about its perimeter to the inner surface of the cylinder. The tending side header includes an air inlet and at least one air outlet, the air outlet being connected to a perimeter groove that is defined about the outer surface of the tending side header, the outer surface of the tending side header being located within the inner surface of the print cylinder. A plurality of air flow apertures are defined within the print cylinder immediately above the perimeter groove whereby an air flow continuum is created from the air inlet of the drive header, through the central conduit, through the tending header inlet, through the tending header outlet, through the perimeter groove and through the cylinder apertures. Additionally, a plurality of secondary apertures are defined within the surface of the cylinder and are connected in an air flow continuum to the central conduit by means of secondary conduits that are sealingly connected to the central conduit and to the inner surface of the print cylinder. In this fashion, the method of the present invention can be used with new print cylinders or incorporated into existing print cylinders, all with the same effect.

The foregoing and other features of the method and apparatus of the present invention will be apparent from the detailed description that follows.

DETAILED DESCRIPTION

Figure 1:
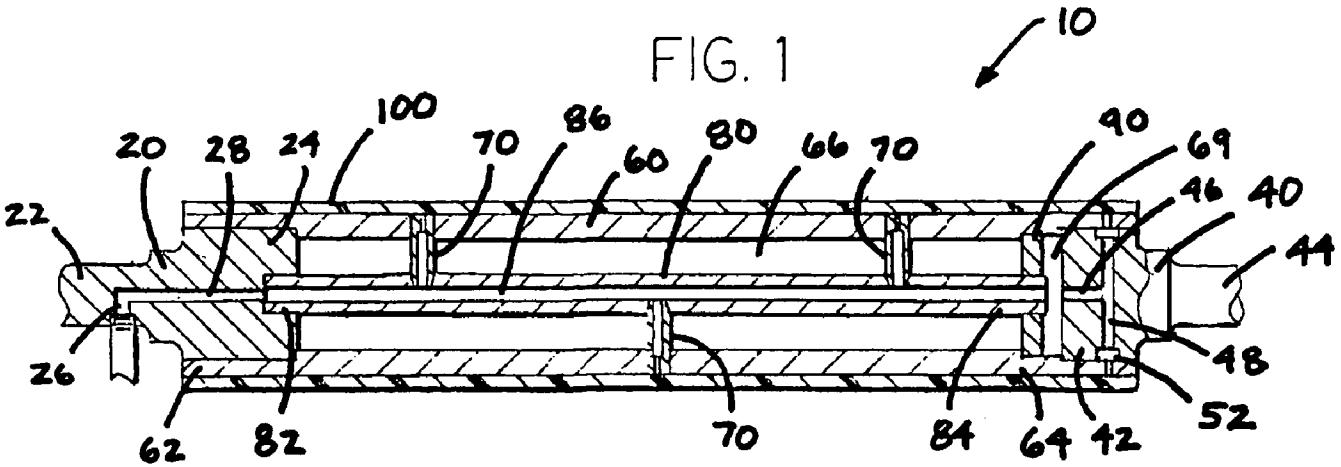
FIG. 1 is a front elevational and cross-sectioned view of a print cylinder constructed in accordance with the present invention.

The following detailed description is intended to describe the preferred embodiment that is depicted in the figures. It is to be understood that changes could be made to that which is specifically described and shown that would still fall within the scope of the present invention. Referring now to the drawings in detail, wherein like numbered elements refer to like elements throughout, FIG. 1 illustrates the basic components of the internally piped print cylinder, generally identified 10, constructed in accordance with the present invention.

Figure 4:
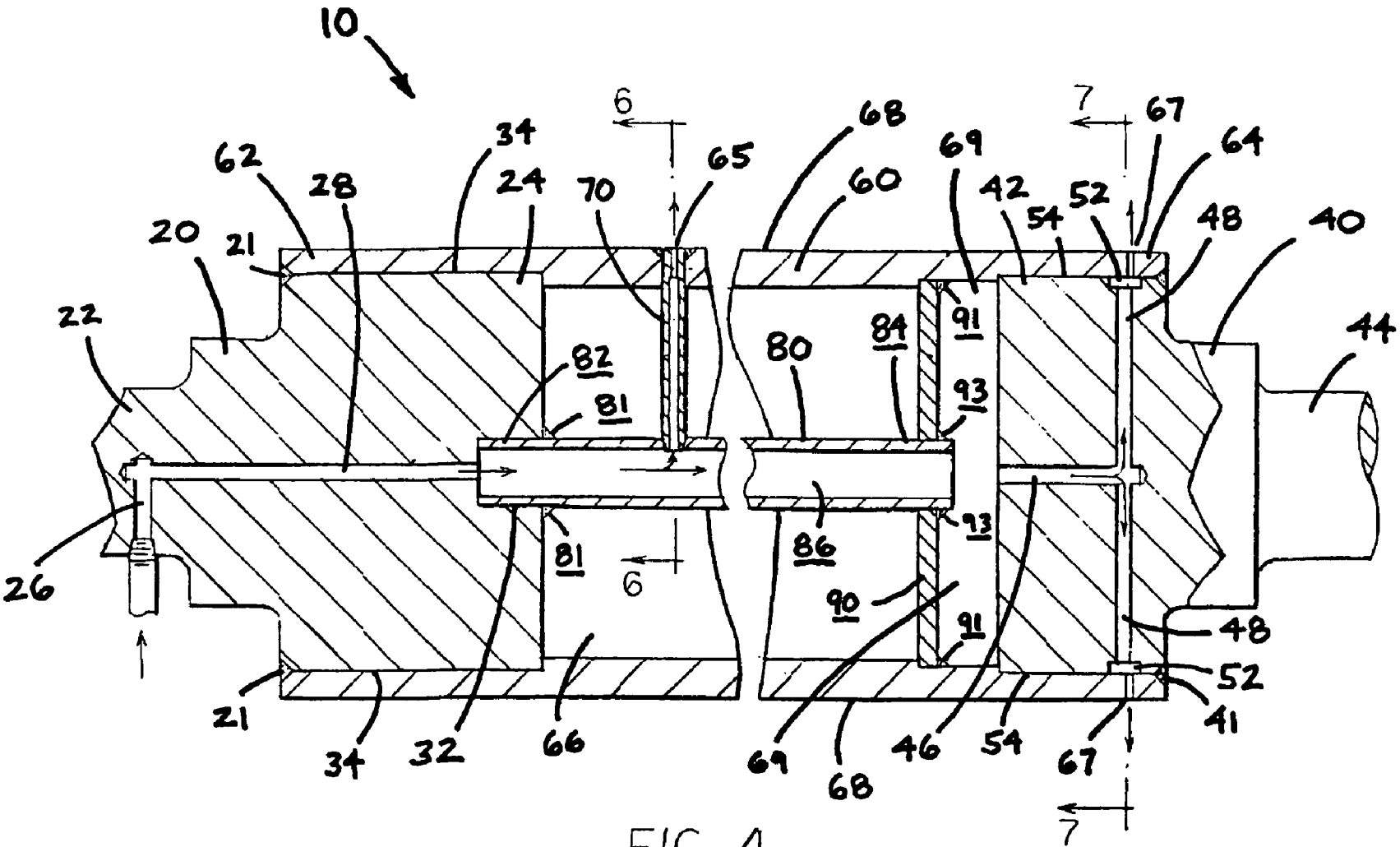
FIG. 4 is an enlarged and cross sectioned view of the internal piping of the print cylinder shown in FIG. 1.

As shown in FIG. 1, and in greater detail in FIG. 4, the print cylinder 10 includes a drive side header 20, a tending side header 40 and a cylindrical portion 60 extending between the headers 20, 40. As shown, the print cylinder 10 also includes an internal central pipe 80.

The drive side header 20 is generally located at the drive side of the printing press (not shown). The drive side header 20 includes a proximal end 22 and a distal end 24. The proximal end 22 of the drive side header 20 includes an air inlet bore 26, the air inlet bore 26 being disposed generally perpendicular to the axis of the drive side header 20. The drive side header 20 also includes a first internal bore 28, the first internal bore 28 being disposed along the axis of the drive side header 20 and intersecting the air inlet 26. The first internal bore 28 extends from the proximal end 22 of the drive side header 20 to the distal end 24 of it. A second internal bore 32 is also provided at the distal end 24 of the drive side header 20 and is axially aligned with the drive side header 20, but is of a diameter that is substantially greater than that of the first internal bore 28. The driver side header 20 also includes an outer surface 34.

The print cylinder 10 also includes a tending side header 40. The tending side header 40 is located at the tending, or operator, side of the printing press (not shown). The tending side header 40 includes a proximal end 42 and a distal end 44. Disposed axially within the proximal end 42 of the tending side header 40 is a first internal bore 46. The first internal bore 46 does not extend through to the distal end 44 of the tending side header 40. Disposed perpendicularly to the axis of the tending side header 40 is a second internal bore 48. The tending side header 40 also includes an outer surface 54. As Shown in FIG. 4, the second internal bore 48 of the tending side header 40 extends from one side of the outer surface 54 of the tending side header 40 to the opposite side of that same circumferential surface 54. It is to be understood, however, that the second bore 48 need only extend to the surface 54 of the tending side header 40 at one point. Defined completely circumferentially within the outer surface 54 of the tending side header 40 is a peripheral groove 52. The shape of this groove 52 is not a limitation of the present invention. The function and purpose of this peripheral groove 52 will become apparent further in this detailed description.

Extending between the drive side header 20 and the tending side header 40 of the print cylinder 10 is a central cylinder portion 60. Situated toward the drive side header 20 is the proximal end 62 of the cylinder 60. Situated at the tending side header 40 is the distal end 64 of the cylinder 60. The cylinder 60 includes an internal cavity 66 that runs substantially the length of the cylinder 60. The cylinder 60 also includes an outer cylinder surface 68.

Figure 5:
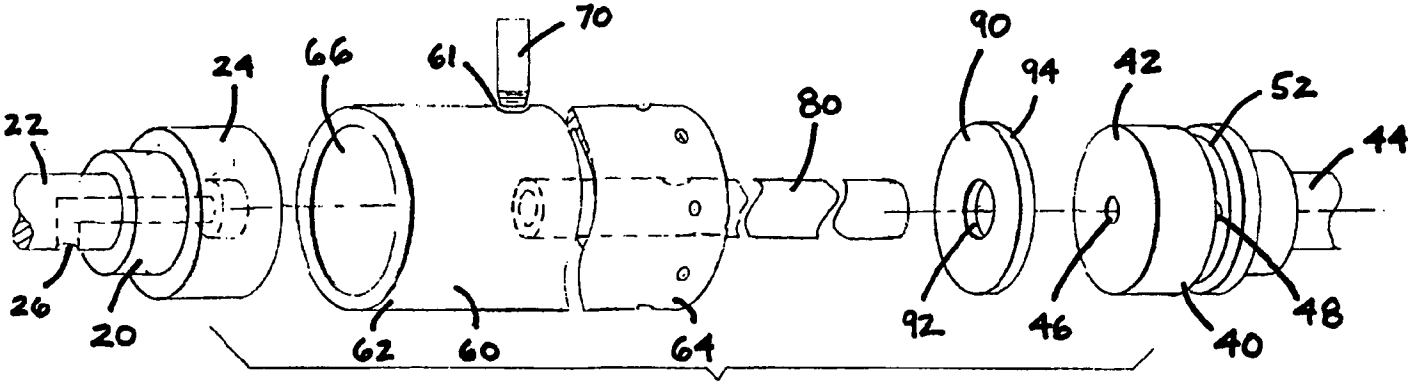
FIG. 5 is an exploded left side and front perspective view of the component parts used in the print cylinder of the present invention.

The print cylinder 10 of the present invention further includes an internal piping arrangement. Specifically, a centrally disposed internal pipe 80 is included and extends between the drive side header 20 and the tending side header 40. The internal pipe 80 does not, however, extend completely to the tending side header 40. The central tube 80 includes a proximal end 82 and a distal end 84. The central tube 80 also includes an internal bore 86 that extends between the proximal end 82 and the distal end 84. The proximal end 82 of the central pipe 80 is functionally adapted to be received by the second internal bore 32 of the drive side header 20. Situated at the distal end 84 of the pipe 80 is a sealing plate 90. The sealing plate includes a central bore 92 and an outer perimeter 94. See FIG. 5. The distal end 84 of the central pipe 80 is functionally adapted to be received within the central bore 92 of the sealing plate 90.

Figure 6:
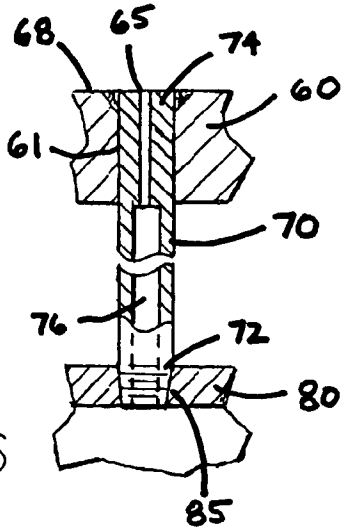
FIG. 6 is a greatly enlarged right side elevational and cross sectioned view of a lateral pipe used in the print cylinder of the present invention taken along line 6—6 in FIG. 4.

Extending outwardly from the central pipe 80, and located at various positions along the length of the print cylinder 10, are a plurality of auxiliary pipes 70. See also FIG. 6. Each auxiliary pipe 70 is disposed generally 180° from the next auxiliary pipe 70. See FIG. 1. Referring again to FIG. 6, it will be seen that each pipe 70 includes a proximal end 72, a distal end 74 and a central bore 76. The proximal end 72 of each auxiliary pipe 70 is functionally adapted to be secured within an aperture 85 defined within the central pipe 80. The distal end 74 of each auxiliary pipe 70 is functionally adapted to be secured within an aperture 61 defined within the outer surface 68 of the central cylinder 60. See FIG. 5. In this fashion, an air pressure and air flow continuum is created between the drive side header inlet 26, the first internal bore 28 of the drive side header, the central pipe bore 86, the auxiliary pipe bore 76 and the outer surface 68 of the central cylinder 60. See FIG. 4.

In application, a basic print cylinder is provided which has a drive side header 20, a central cylinder 60 and a tending side header 40 as previously described. These basic elements would be original manufacture items that are being modified at the time of manufacture or retrofitted at a later time after the cylinder 10 has been used in production for a period of time.

With the drive side header 20 separated from the central cylinder 60, the inlet bore 26 and the first and second internal bores 28, 32, respectively, are drilled into the drive side header 20. The proximal end 82 of the central pipe 80 is then threadably secured or welded 81 into the second internal bore 32 of the drive side header 20. The drive side header 20 and the central cylinder 60 are then reattached, preferably by weldment 21. The sealing plate 90 is then positioned such that the central bore 92 of the plate 90 engages the distal end 84 of the central pipe 80. The outer periphery 94 of the plate 90 is placed internally of the distal end 64 of the cylinder 60. The sealing plate 90 is then welded 91, 93 to the cylinder 60 about its periphery 94 and to the central pipe 80 about the central bore 92, respectively.

Figure 7:
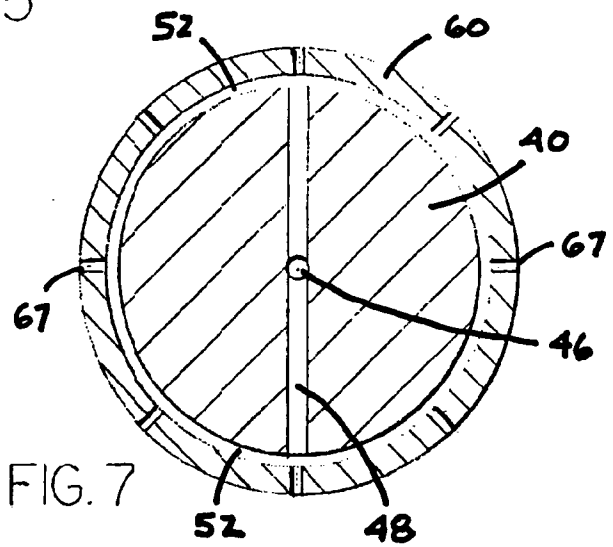
FIG. 7 is a right side elevational and cross sectioned view of the tending side header of the print cylinder of the present invention taken along line 7—7 in FIG. 4.

The tending side header 40 is also modified to include the internal bores 46, 48 and periphery groove 52 as previously described and is then welded 41 back into the distal end 64 of the central cylinder 60. In this fashion, a relatively small central cylindrically-shaped void 69 is created between the sealing plate 90 and the proximal end 42 of the tending side header 40. With these elements in place, the outer surface 68 of the central cylinder 60 is then strategically and carefully drilled to intersect axially with the central pipe 80. The central pipe apertures 85 are then threaded and the auxiliary pipes 70 are inserted and the proximal pipe end 72 is secured. At the outer surface 68 of the central cylinder 60, the distal pipe end 74 is welded into place and a small hole 65 is drilled through the weldment. Similar small holes 67 are drilled about the periphery of the central cylinder 60 at its distal end 64, such holes 67 being aligned with the periphery groove 52 of the tending side header 40 which lies directly below them. As shown in FIG. 7, these small holes 67 are aligned at 45° relative to one another.

Figure 2:
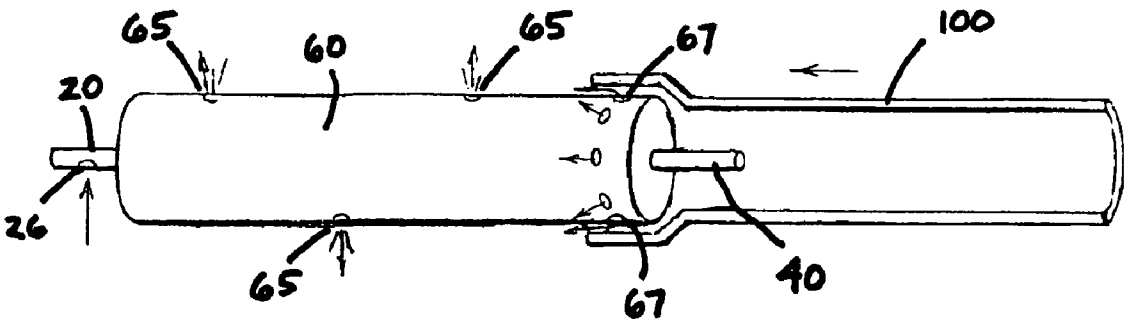
FIG. 2 is a front and right side perspective view of the internally piped print cylinder constructed in accordance with the present invention and illustrating a print sleeve being slid over the outer surface of the cylinder.
Figure 3:
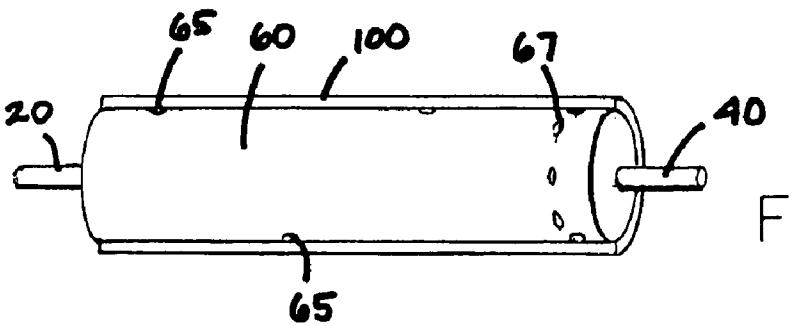
FIG. 3 is a front and right side perspective view of the print cylinder and sleeve illustrated in FIG. 2 and showing the sleeve in its fully attached position.

When pressurized air is applied to the air inlet 26 of the drive side header 20, the air flow continues through the first and second internal bores 28, 32, respectively, of the drive side header, and into the bore 86 of the central pipe 80. Pressurized air then continues through each of the auxiliary pipes 70 and through the hole 65 at the surface 68 of the central cylinder. Pressurized air fills the void 69 between the sealing plate 90 and the proximal end 42 of the tending side header 40 and enters the first bore 46 thereof. The pressurized air flows through the secondary bore 48 to the periphery groove 52 of the tending side header 40 and escapes through the holes 67 defined above the groove 52. In this fashion, a sleeve 100 may be placed over the cylinder 10 as pressurized air creates a layer of air over which the sleeve 100 may pass. See FIGS. 2 and 3. It is to be understood that the expansion of the sleeve 100 as shown in FIG. 2 is greatly exaggerated. A greater number of holes 67 at the tending side header 40 end of the cylinder 10 is desirable to assist with initial placement of the sleeve 100 onto the cylinder 10.

Accordingly, it will be seen from the foregoing that there has been provided a new and useful print cylinder that is internally piped so as to facilitate the application of a print sleeve to the cylinder and to facilitate the removal of the print sleeve from the cylinder; that provides an apparatus and a method for making the internally piped print cylinder such that a much smaller volume of space is required to be pressurized in order to accomplish the intended result; that is fabricated in accordance with the method of the present invention as original equipment or as a retrofit to an existing cylinder with the same effect; and which accomplishes all of the foregoing without great expense, which will allow printers to readily and easily use the device, and which utilizes a minimum number of elements to assemble and a minimum number of steps to operate.

The principles of this invention having been described in accordance with the foregoing, we claim:

1. An internally piped print cylinder comprising:

a drive side header; said drive side header including an air inlet bore;

a tending side header, the tending side header including a central axis, a proximal end and a distal end, an air outlet means including a first internal bore disposed axially within the proximal end of the tending side header but not extending fully through to the distal end of the tending side header, at least one second internal bore disposed perpendicularly to the axis of the tending side header, and an outer circumferential surface, the second internal bore extending from one side of the outer surface to the first internal bore;

a thin walled print cylinder extending longitudinally between the drive side header and the tending side header, said thin walled print cylinder having an outer surface and a hollow inside area;

a sealing plate, the sealing plate being disposed within the hollow inside area of the cylinder towards so as to create a cylindrically-shaped void between the sealing plate and the tending side header, the sealing plate having a central bore;

a centrally disposed internal pipe, the internal pipe comprising a proximal end, a distal end, an internal bore that extends between the proximal end and the distal end, the proximal end of the internal pipe being functionally adapted to be received by the second internal bore of the drive side header, the distal end of the internal pipe being received within the central bore of the sealing plate, the internal pipe forming an air flow continuum with the cylindrically-shaped void created between the sealing plate and the drive side header and with the air inlet bore of the drive side header; and a plurality of axially extending pipes for passing air from the internal pipe to the cylindrical portion of the print cylinder and to the air outlet means of the tending side header;

wherein air applied to the air inlet means of the drive side header passes to the outer surface of the print cylinder.

2. The print cylinder of claim 1 wherein the drive side header has a central axis, a proximal end and a distal end, and the air inlet means includes an air inlet bore that is disposed generally perpendicular to the axis of the drive side header at the proximal end of the drive side header, a first internal bore that is disposed along the axis of the drive side header and intersects the air inlet bore, the first internal bore extending from the proximal end of the drive side header to the distal end, and a second internal bore that is axially aligned with the drive side header, but is of a diameter that is greater than that of the first internal bore.

3. The print cylinder of claim 2 including a plurality of auxiliary pipes extending outwardly from the centrally disposed internal pipe, said auxiliary pipes being located at various positions along the length of the print cylinder.

4. The print cylinder of claim 3 wherein each auxiliary pipe is radially disposed generally 180 degrees from the next adjacent auxiliary pipe.

5. The print cylinder of claim 3 wherein the centrally disposed internal pipe includes a plurality of apertures defined within it, the outer surface of the cylinder includes a plurality of apertures defined within it, and each auxiliary pipe includes a proximal end, a distal end and a central bore, the proximal end of each auxiliary pipe being functionally adapted to be secured within an aperture defined within the internal pipe and the distal end being functionally adapted to be secured within an aperture defined within the cylindrical portion outer surface.

6. The print cylinder of claim 5 wherein the air outlet means of the tending side header includes a plurality of holes defined about the periphery of the cylindrical portion, such holes being aligned with the peripheral groove of the tending side header to form an air flow continuum therewith.

7. The print cylinder of claim 6 wherein the holes are aligned at 45 degrees relative to one another.

8. A method for making an internally piped print cylinder comprising the steps of:

providing a relatively thin-walled print cylinder having a drive side header, a central axis, a proximal end and a distal end;

creating a first air inlet bore that is disposed generally perpendicular to the axis of the drive side header at the proximal end of the drive side header;

creating a first internal bore that is disposed along the axis of the drive side header and intersects the air inlet bore, the first internal bore extending from the proximal end of the drive side header to the distal end;

creating a second internal bore that is axially aligned with the drive side header, but is of a diameter that is greater than that of the first internal bore;

providing a tender side header;

creating a first internal bore in the tender side header;

creating a circumferential groove around the tender side header;

creating a second internal bore extending axially outwardly from the first internal bore into the circumferential groove;

providing a centrally disposed internal pipe, the internal pipe comprising a proximal end, a distal end, an internal bore that extends between the proximal end and the distal end, the proximal end of the internal pipe being received by the second internal bore of the drive side header;

providing a sealing plate, said sealing plate including a central bore and an outer perimeter, the distal end of the internal pipe being functionally adapted to be received within the central bore of the sealing plate, the internal pipe forming an air flow continuum with the air inlet bore of the drive side header; and providing a plurality of auxiliary pipes, each of said plurality of auxiliary pipes being connected in air flow continuum to the internal pipe and to the exterior of the print cylinder; and providing a plurality of air flow apertures within the cylinder, each of said plurality of air flow apertures being aligned with an auxiliary pipe or with the peripheral groove of the tending side header.

9. The method of claim 8 wherein each auxiliary pipe is axially disposed generally 180 degrees from the next adjacent auxiliary pipe.

10. The method of claim 9 wherein the air flow apertures that are aligned with the peripheral groove of the tending side header are disposed 45 degrees from one another.

* * * * *